US005980318A

United States Patent [19]

Morello et al.

[11] Patent Number: 5,980,318

[45] Date of Patent: Nov. 9, 1999

[54] CONNECTOR WITH A FLEXIBLE BEAM FOR HOLDING A TERMINAL DOWN AND IN POSITION

[75] Inventors: John Raymond Morello, Lake Milton; Thomas Gilbert Morello, Cortland; William Gilbert Strang, Warren, all of Ohio

[73] Assignee: General Motors Corporation, Detroit, Mich.

[21] Appl. No.: 08/948,742

[22] Filed: Oct. 10, 1997

Related U.S. Application Data

[60] Provisional application No. 60/050,706, Jun. 25, 1997.

[51] Int. Cl.[6] ..... H01R 13/40

[52] U.S. Cl. ..... 439/595; 439/603

[58] Field of Search ..... 439/595, 603, 439/744

[56] References Cited

U.S. PATENT DOCUMENTS 4,842,541 6/1989 Leaderis ..... 439/744

5,017,162 5/1991 Krehbiel et al. ..... 439/595

5,575,684 11/1996 Uchida et sl. ..... 439/595

*Primary Examiner*—Neil Abrams

*Assistant Examiner*—T C Patel

*Attorney, Agent, or Firm*—Cary W. Brooks; Patrick M. Griffin

[57] ABSTRACT

An electrical connector includes a connector body with a plurality of terminal receiving cavities formed therein. Each terminal receiving cavity is defined in part by a rigid floor and opposed upright walls. A rigid lock nib extends upwardly from the rigid floor into the terminal receiving cavity. A flexible beam opposes the rigid floor, and preferably includes a terminal hold down bump extending towards the rigid floor at a location generally opposite the rigid lock nib. The connector body is constructed and arranged for receiving a female terminal in each of the terminal receiving cavities. The female terminal may include a first and second end, and a body portion therebetween. The first end is open to receive a male terminal and the second end is constructed for attachment to a wire. The body portion includes a recess or aperture formed therein, defined in part by a rigid lock edge engaging a portion of the rigid lock nib.

6 Claims, 2 Drawing Sheets

CONNECTOR WITH A FLEXIBLE BEAM FOR HOLDING A TERMINAL DOWN AND IN POSITION

This application claims the filing benefits of a provisional application U.S. Ser. No. 60/050,706 entitled "Connector with a Flexible Beam for Holding a Terminal Down and In Position", filed Jun. 25, 1997.

FIELD OF THE INVENTION

This invention relates to electrical connectors, and more particularly to electrical connectors having female terminals received in cavities of a connector body.

BACKGROUND OF THE INVENTION

It is common in the prior art to provide an electrical connector having a female terminal received in a terminal cavity of a connector body. The female terminal may be held in the connector body by flexible locking tangs or fingers. The flexible locking tangs or fingers may be formed as a part of the female terminal or the connector body. Female terminals having flexible locking tangs or fingers are complicated structures to manufacture, often having at least two separate pieces to be assembled and often are large and bulky. Similarly, connector bodies having flexible locking tangs or fingers are large and bulky, and are difficult to tool and injection mold. Another disadvantage of these devices having flexible locking tangs or fingers is that the system provides only a flexible locking member engaging a rigid locking member. Unfortunately, the flexible locking member may become inadvertently disengaged, allowing the female terminal to be removed from the connector body.

The present invention provides alternatives to and advantages over the prior art.

BRIEF DESCRIPTION THE DRAWINGS

FIG. 1 is a sectioned perspective view of a connector according to the present invention; and FIG. 2 is a sectioned perspective view of an alternative embodiment of a connector according to the present invention.

SUMMARY OF THE INVENTION

The invention includes an electrical connector having a connector body with a plurality of terminal receiving cavities formed therein. Each terminal receiving cavity is defined in part by a rigid floor and opposed upright walls. A. rigid lock nub or nib extends upwardly from the rigid floor into the terminal receiving cavity. A flexible beam opposes the rigid floor, and preferably includes a terminal hold down bump extending towards the rigid floor at a location generally opposite the rigid lock nib. The connector body is constructed and arranged for receiving a female terminal in each of the terminal receiving cavities. The female terminal may include a first and second end, and a body portion therebetween. The first end is open to receive a male terminal and the second end is constructed for attachment to a wire. The body portion includes a recess or aperture formed therein, defined in part by a rigid lock edge for engaging a portion of the rigid lock nib.

The female terminal may be inserted into the terminal cavity so that the terminal is engaged by the rigid lock nib and the flexible beam until the aperture or recess in the terminal overlies the rigid lock nib. At this point, the flexible beam forces the female terminal downward towards the rigid floor and so that the rigid lock nib is received in the aperture or recess. In this final position, the rigid lock edge of the female terminal engages the lock nib firmly holding the female terminal in position and preventing inadvertent rearward withdrawal of the terminal from the cavity.

In an alternative embodiment of the invention, the terminal receiving cavities may be rotated 180 degrees so that adjacent terminal receiving cavities have a common rigid floor. This greatly reduces the overall dimensions of the connector.

These and other objects, features, and advantages of the present invention will be apparent from the following brief description of the drawings, detailed description, and appended claims and drawings.

DETAILED DESCRIPTION

Figure 1:
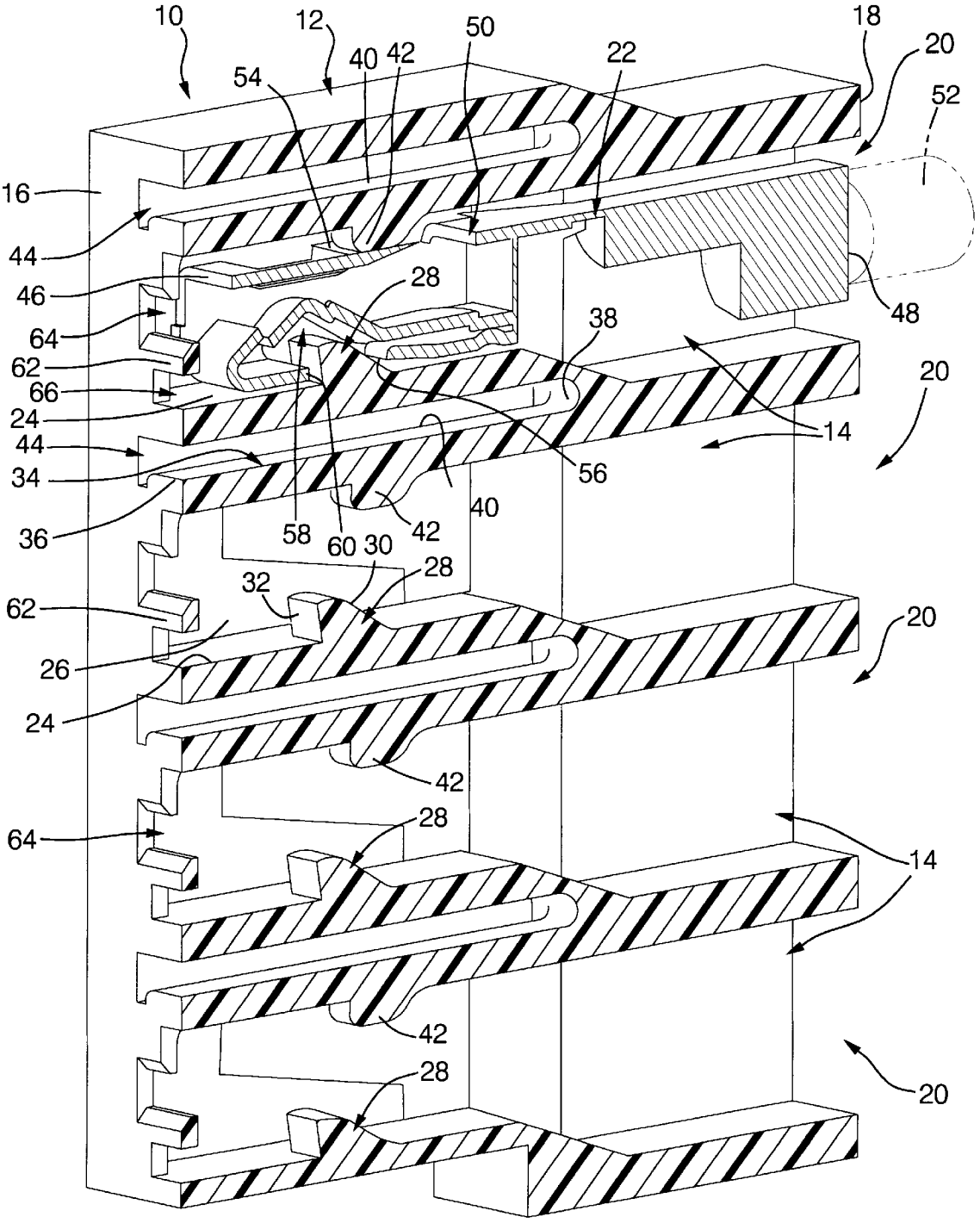

Referring to FIG. 1, an electrical connector 10 according to the present invention includes a connector body 12 having a plurality of terminal receiving cavities 14 formed therein. The connector body 12 includes a front face 16 and a rear face 18. The rear face 18 has a plurality of openings 20, each aligned with a terminal receiving cavity 14 to facilitate insertion of a male or female terminal 22 into the cavity 14 through the rear face opening 20. The terminal receiving cavity 14 is defined in part by a rigid floor 24 and opposed upright walls 26. The rigid floor 24 is attached along at least two edges and preferably along all (four) edges to prevent movement or flexing of the floor. A rigid lock nib 28 extends upwardly from the rigid floor 24 into the terminal receiving cavity 14. The rigid lock nib 28 includes a sloped surface 30 that starts nearest the rear face 18 of the connector body and terminates at a rigid lock shoulder 32 on the nib formed nearest the front face 16. A flexible beam 34 opposes the rigid floor 24 and preferably has first and second ends 36, 38 attached to the front face 16 and rear face 18 of the connector body, respectively. Preferably, the flexible beam 34 is attached only at the ends 36, 38 and not along sides 40 of the beam. A terminal hold down bump 42 may be provided extending towards the rigid floor 24 at a location generally opposite the rigid lock nib 28. A second cavity 44 may be defined in the Connector body above the flexible beam 34 to facilitate movement or deflection of the beam 34.

The connector body 12 is constructed and arranged for receiving a female terminal 22 in each of the terminal receiving cavities 14. The female terminal 22 may include a first 46 and second end 48, and a body portion 50 therebetween. The first end 46 is open to receive a male terminal. The second end 48 is constructed for attachment to a wire 52, and preferably includes a metal crimp section. The body portion 50 has a top surface 54, and a bottom surface 56 that has a recess or an aperture 58 formed therein for receiving the rigid lock nib 28. The body portion 50 includes a rigid lock edge 60 associated with the recess or aperture for engaging the rigid lock shoulder 32 of the nib.

To assemble the connector, the first end 46 of the female terminal is inserted through the opening 20 in the rear face 18 and into the terminal cavity 14. The first end 46 of the female terminal engages the nib 28 and the terminal rides up the sloped surface 30 lifting the terminal off of the rigid floor 24. As the female terminal is riding up the sloped surface 30 of the nib, the top surface 54 engages the bump 42 and the beam flexes upward into the second cavity 44 to accommodate the movement of the terminal between the lock nib 28 and the bump 42. The female terminal is pushed forward further until the recess or aperture 58 overlies the rigid lock nib 28 at which point the terminal is forced to the rigid floor 24 by the resilient force of the flexible beam 34 and bump 42 bearing on the top surface 54 of the terminal. The flexible beam 34 and bump 42 apply a sufficient force to hold the terminal down in position and to maintain the rigid lock edge 60 against the rigid lock shoulder 32 of the nib thus preventing inadvertent rearward withdrawal of the terminal from the cavity 14. Unlike prior connectors with flexible locking tangs of fingers, the lock edge 60 and lock shoulder 32 provide a ridge to rigid surface locking feature holding the terminal in this final position.

A stop 62, such as the inside wall of the front face 16, is provided in the connector body to prevent the terminal 22 from moving in a forward direction. A male terminal blade or shaft may be inserted through a first opening 64 in the front face 16 of the connector and into the open end 46 of the female terminal. Another (third) opening 66 may be provided in the front face 16 of the connector and communicating with the first cavity 14 so that a tool may be inserted therethrough to lift up the female terminal 22 so that the lock edge 60 is above the lock nib 28 thereby allowing the female terminal to be removed through the opening 20 in the rear face 18.

Figure 2:
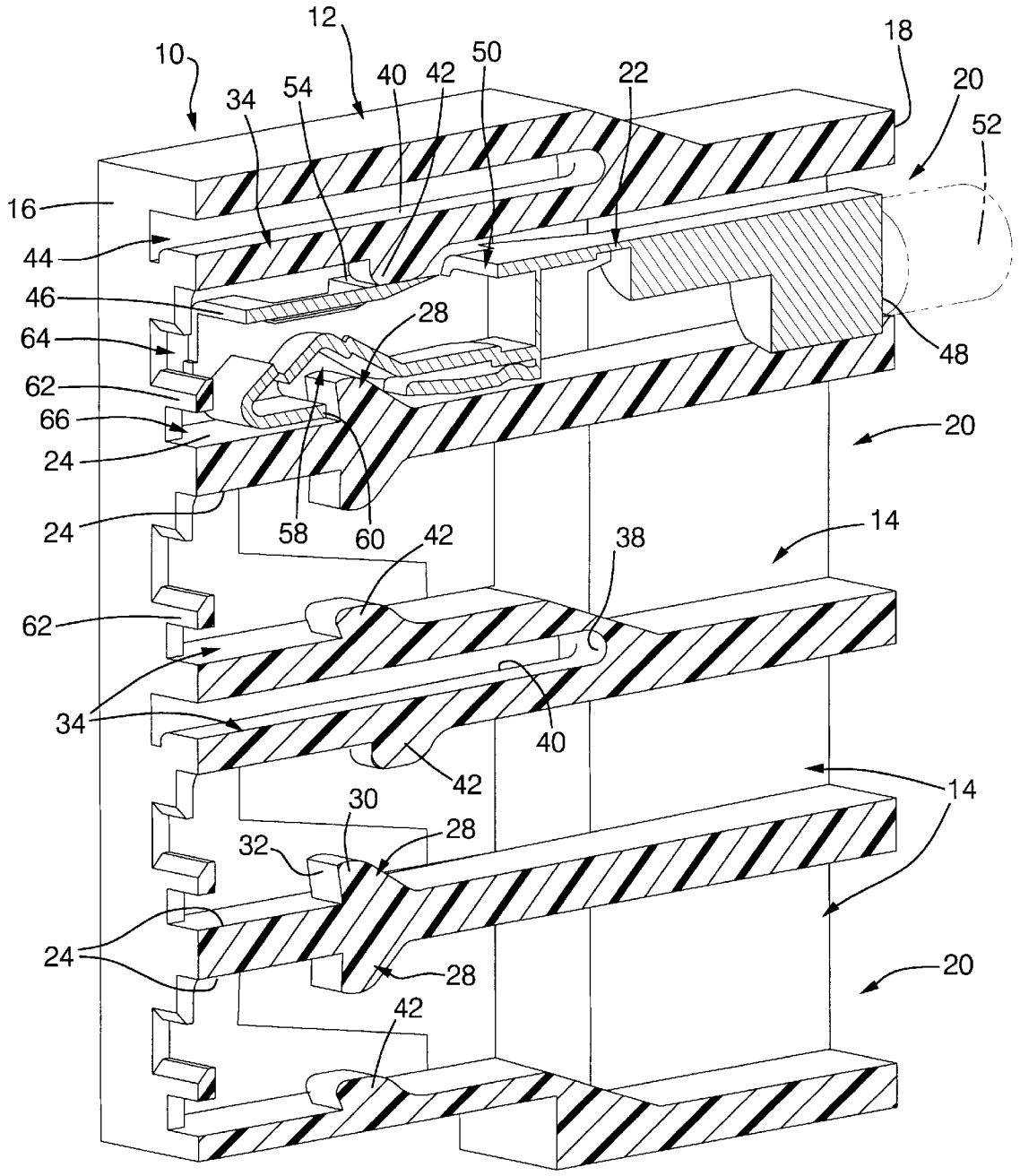

In an alternative embodiment of the invention, the terminal receiving cavities may be rotated 180 degrees so that adjacent terminal receiving cavities have a common rigid floor 24, as shown in FIG. 2. This greatly reduces the overall dimensions of the connector.

The electrical connector according to the present invention has a low profile, is simple in design, easy to manufacture, and provides a rigid to rigid surface locking feature of the terminal that heretofore has been absent in prior art designs.

We claim:

1. An electrical connector comprising:

a connector body, a female terminal and a wire, the connector body having a plurality of terminal receiving cavities formed therein, the plurality of the terminal receiving cavities each being defined in part by a rigid floor and opposed walls, a rigid lock nib extending from the rigid floor into the terminal cavity, a flexible beam extending into the terminal receiving cavity overlying the rigid lock floor, the connector body having a first and second face, the first face having a first opening for each terminal receiving cavity for receiving a male terminal therethrough, the second face having a second opening for each terminal receiving cavity for insertion of the female terminal therethrough, the terminal having a first end, and second end secured to the wire and a body portion between the ends, the body portion having a top surface, and a bottom surface including a recess defined therein for receiving the rigid lock nib, the recess being defined in part by a rigid lock edge in the bottom surface, the terminal being received in the terminal receiving cavity so that the flexible beam engages the top surface of the female terminal biasing the terminal towards the rigid floor, and the rigid lock nib is received in the recess so that the rigid lock edge engages the nib preventing the female terminal from being inadvertently withdrawn from the terminal receiving cavity through the second opening, and wherein the first face includes a third opening communicating with the terminal receiving cavity for insertion of a tool to lift the terminal up so that the rigid lock edge is above the rigid lock nib and so that the terminal may be withdrawn from the terminal cavity through the second opening.

2. An electrical connector as set forth in claim 1 wherein the flexible beam further includes a terminal hold down bump extending into the terminal receiving cavity at a location generally opposite the rigid lock nib.

3. An electrical connector as set forth in claim 1 further comprising a stop formed in the connector body for each terminal receiving cavity to prevent forward movement of the female terminal through the first opening.

4. An electrical connector as set forth in claim 1 wherein at least two adjacent terminal receiving cavities are defined by a common rigid floor.

5. An electrical connector as set forth in claim 1 wherein the flexible beam this secured at first and second ends and is detached along opposed sides.

6. An electrical connector as set forth in claim 1 wherein the terminal is of the female type and the first end is open to receive a male terminal.

* * * * *